US005754143A

United States Patent [19]

Warnagiris et al.

[11] Patent Number: 5,754,143

[45] Date of Patent: May 19, 1998

[54] SWITCH-TUNED MEANDERED-SLOT ANTENNA

[75] Inventors: Thomas J. Warnagiris; Thomas J. Minardo, both of San Antonio; Donald R. Bannon, Helotes, all of Tex.

[73] Assignee: Southwest Research Institute, San Antonio, Tex.

[21] Appl. No.: 738,580

[22] Filed: Oct. 29, 1996

[51] Int. Cl.[6] ..... H01Q 13/10

[52] U.S. Cl. ..... 343/767; 343/895; 343/746; 343/795

[58] Field of Search ..... 343/767, 768, 343/770, 771, 895, 745, 746, 749, 793, 796, 795; H01Q 13/10

[56] References Cited

U.S. PATENT DOCUMENTS

| | | | |
|---|---|---|---|
| 2,601,610 | 6/1952 | Hatch et al. | 343/768 |
| 3,568,205 | 3/1971 | Buxton | 343/749 |
| 3,604,012 | 9/1971 | Lindley | 343/768 |
| 3,754,271 | 8/1973 | Epis | 343/756 |
| 4,123,759 | 10/1978 | Hines et al. | 343/854 |
| 4,381,566 | 4/1983 | Kane | 343/747 |
| 4,564,843 | 1/1986 | Cooper | 343/745 |
| 4,656,483 | 4/1987 | Jaquet | 343/745 |
| 4,742,355 | 5/1988 | Wolfson et al. | 343/767 |
| 4,751,513 | 6/1988 | Daryoush et al. | 343/700 MS |
| 4,772,893 | 9/1988 | Iwasaki | 343/779 |
| 5,136,303 | 8/1992 | Cho et al. | 343/718 |
| 5,296,867 | 3/1994 | Jaquet | 343/745 |
| 5,367,310 | 11/1994 | Warnagiris | 343/745 |

OTHER PUBLICATIONS

Nakano, H., et al., "Shortening Ratios of Modified Dipole Antennas," IEEE Transactions on Antennas and Propagation, vol. AP-32, No. 4, Apr. 1984, pp. 385–386.

Rashed, J., et al., "A New Class of Resonant Antennas," IEEE Transactions on Antennas and Propagation, vol. 39, No. 9, Sep. 1991, pp. 1428–1430.

*Primary Examiner*—Hoanganh T. Le

*Attorney, Agent, or Firm*—Akin, Gump, Strauss, Hauer & Feld, L.L.P.

[57] ABSTRACT

An electrically-short meandered-slot antenna having a plurality of switch-selected resonant frequencies is described. Meander slot sections are substantially parallel, closely coupled, electrically significant, and substantially equal in length to the overall monopole length of the antenna. Switching among resonant frequencies is accomplished with shunt switches across the antenna slot, the switches preferably being powered inductively and selectively at individual frequencies outside the operating band of the antenna.

14 Claims, 4 Drawing Sheets

SWITCH-TUNED MEANDERED-SLOT ANTENNA

The U.S. Government has a paid-up license in this invention and the right in limited circumstances to require the patent owner to license others on reasonable terms as provided for by the terms of contract No. DAAB07-93-C-B759 awarded by the U.S. Army Communications-Electronics Command, AMSEL-RD-C3-D, Fort Monmouth, N.J. 07703-5203.

BACKGROUND

Field of the Invention

This invention relates to methods and apparatus for tuning antennas, and in particular for switch-tuning meandered-slot antennas.

Problems in Reducing Antenna Size

In general, the most efficient antennas for a given frequency have elements with a long dimension which is an integer multiple of a quarter-wavelength. For example, a half-wavelength dipole antenna is generally suitable for both transmitting and receiving. Antennas of such dimensions, however, are impractically large in many applications using the HF band (2 to 32 MHz). Considerable effort has thus been expended in attempts to reduce antenna size while retaining radiation efficiency.

Electrically short antennas are now used in many mobile and transportable applications but are frequently relatively inefficient compared to larger antennas, in part because the impedance of electrically-short antennas is usually substantially different from the impedance of equipment to which they must be connected. Using additional network elements to match other equipment to electrically-short antenna impedances (characterized by low radiation resistance and relatively large reactance) consumes energy and lowers radiation efficiency. Further, the rapid increase of antenna reactance which accompanies decreasing antenna size results in relatively high radio-frequency voltages in impedance matching networks connected to high-power antennas. And compounding these problems is the relatively narrow bandwidth of electrically-short antennas.

Proposed Improvements for Electrically-Short Antennas

A special case of the electrically-short antenna, that of the vertical antenna, appears particularly amenable to improvement of its bandwidth and radiation resistance. Capacitive top loading and inductive loading (in some cases to within a short distance from the antenna top) have increased radiation efficiencies, but power losses (especially in loading coils) limit the improvements practically attainable. Resistive antenna loading causes mismatched energy at non-resonant frequencies to be dissipated, assuring a matched feed to a transmitter at the cost of efficiency at non-resonant frequencies. While simple and reliable, these techniques produce sub-optimal performance.

Another technique which promises improved antenna performance is antenna folding, which results in a beneficial increase in radiation resistance with no decrease in antenna bandwidth. Addition of capacitive top loading to a folded antenna can result in improved bandwidth and radiation resistance, but electrically short antennas are regarded as fundamentally limited in these two important parameters. Further, switch tuning of electrically short antennas has been regarded as problematical because of time-varying changes in antenna impedance caused by the antenna environment.

SUMMARY OF THE INVENTION

The invention includes electrically-short meandered-slot switch-tuned antennas, each antenna comprising an electrically conductive sheet which itself comprises an elongated meandered slot having first and second longitudinal slot edges. The meandered slot comprises a plurality of substantially parallel meander sections of substantially uniform length joined end-to-end in series at folds. The meander (that is, folding) of the slot reduces overall antenna size while maintaining a relatively high radiation resistance at resonance.

In general, electrically-short meandered-slot antennas (for example, about 0.03 wavelengths) having narrow slots (relative to total slot length, which can be varied to tune an antenna) have an acceptably low VSWR (voltage standing wave ratio) of less than about 2:1 across only a relatively narrow bandwidth (for example, about 2% to about 4% of center frequency). Although this bandwidth is comparable to that of reactively loaded monopole antennas of comparable length, it is further increased in antennas of the present invention by providing for one or more alternative switch-selected antenna resonant frequencies.

The resonant frequency selection function is accomplished by placing shunt RF (radio frequency) switching means at one or more locations substantially transversely across the first and second longitudinal edges of the meandered antenna slot. Shunt RF switching means thus can short out a portion of the slot, changing the effective antenna slot length (and with it the antenna resonant frequency). Shunt RF switching means comprise at least one switchable conducting element connected across the antenna slot via a path of relatively low RF impedance. Switchable conducting elements may comprise, for example, a manually-controlled shorting bar or mechanical switch which incorporates, in connections to the antenna's conductive sheet, the needed low RF impedance path across an antenna slot. Other preferred embodiments of the switch-tuned meandered-slot antenna may be comprised of one or more remotely controllable switchable conducting elements, each comprising one or more PIN diodes and/or FET's (field-effect transistors). Switchable conducting elements, whether manually placed or remotely controllable, can be spaced at any effective distance along a meandered antenna slot to create an antenna resonance within a predetermined range when the switchable conducting element is switched to a conducting state.

Spacing distance for switchable conducting elements is conveniently (and preferably) measured longitudinally (that is, along the elongated dimension) of a meandered slot in either direction from an antenna terminal pair comprising the first and second terminals on the antenna's conductive sheet. These first and second terminals (which serve to connect the antenna through a transmission line to receiving and/or transmitting equipment) are located on opposite (longitudinal) sides of the slot. The first terminal (for connecting the center conductor of a coaxial transmission line to the antenna) is proximate the first antenna slot edge, while the second terminal is typically a ground connection established through conductive bonding (as by soldering) of the shield of a coaxial transmission line to the electrically conductive sheet on the opposite side of the antenna slot from the first terminal (preferably at a point proximate the second antenna slot edge and substantially transversely across the slot from the first antenna terminal). Note that an elongated antenna slot for a monopole antenna is asymmetrical with respect to the first antenna terminal; it may be open at one end and closed at the other end with an antenna first terminal located along the slot between the open and closed ends. Either or both open and closed antenna slot ends can comprise a switchable conducting element so that open and closed slot ends may be interchanged and the spacing of open and closed slot ends with respect to an antenna terminal pair located between the two ends (and along the slot) can be changed by selective switching of certain switchable conductive elements between conductive and nonconductive states.

Thus, both antenna first terminals and switchable conducting elements can be located anywhere along an antenna slot; they are, however, preferably placed proximate meander section ends (that is, at or near folds) for easy access and to reduce required runs of any switch control lines that may be present. Note that since the slot length within folds is much less than the meander section length, and since meander sections are substantially parallel, alternate folds (which are separated by an even number of meander sections and an odd number of folds) tend to be closely spaced. This is in contrast to folds which are separated by an odd number of meander sections (and thus are always separated by at least the length of a meander section). Hence, antenna first terminals and switchable conducting elements which are located at alternate folds may be conveniently grouped physically (as at or near the base of a meandered-slot monopole antenna).

During typical antenna use with remotely controlled switchable conducting elements, bias currents and/or control voltages are applied as necessary to components such as PIN diodes and FET's to switch RF power flow on or off. Control circuits that direct the RF power switching are preferably isolated from RF power flow within the antenna to prevent corruption of the control signals. The shunt configuration of the RF switching means in antennas of the present invention allows control of the switches with minimal coupling of RF energy from the antenna to the control circuits. Thus, the extra costs of photonically controlled RF switches (required in many series-switched antenna applications) can be avoided. Instead, for RF switching means (which are preferably located proximate alternate folds), control signals and/or power for maintaining bias currents and/or control voltages may be coupled to each switchable conducting element inductively (preferably over a distance of about 2 to about 20 cm) at a frequency outside of the operating band of the antenna. Further, each switchable conducting element of a plurality of switchable conducting elements can be tuned to specific frequency and may then be addressed individually by changing the frequency of the inductive field.

Thus, easy access to folds and easy control of switchable conducting elements reduces the marginal cost of additional meander sections in an antenna. And because the radiation resistance of a folded antenna tends to rise with the addition of more folded elements, antennas of the present invention preferably comprise at least four substantially parallel meander slot sections of substantially equal length, that length preferably being substantially equal to the overall monopole length of the antenna. All meander slot sections are preferably closely coupled and electrically significant (meaning that shunting any slot section with RF switching means significantly changes the antenna resonant frequency).

To accommodate the multiple slot folds required for additional meander sections, the conductive sheet containing the meandered antenna slot is preferably folded in a substantially cylindrical or substantially elliptical form, the longitudinal axis of symmetry of each form being substantially parallel to the long dimension of each meander slot section. Note that substantially cylindrical forms include forms resembling a right circular cylinder except that the two cylinder ends have slightly different diameters. However the slotted conductive sheet is folded, meander slot sections are preferably oriented in use substantially perpendicular to a ground plane (comprising, for example, earth, a metallic sheet, or a conductive wire grid). The slotted conductive sheet is also preferably connected to the ground plane to increase protection against lightning strikes for equipment connected to the antenna.

BRIEF DESCRIPTION OF THE FIGURES

FIG. 3C schematically illustrates a meandered-slot switch-tuned monopole antenna in a substantially cylindrical form spiraling in.

DETAILED DESCRIPTION

Figure 1:
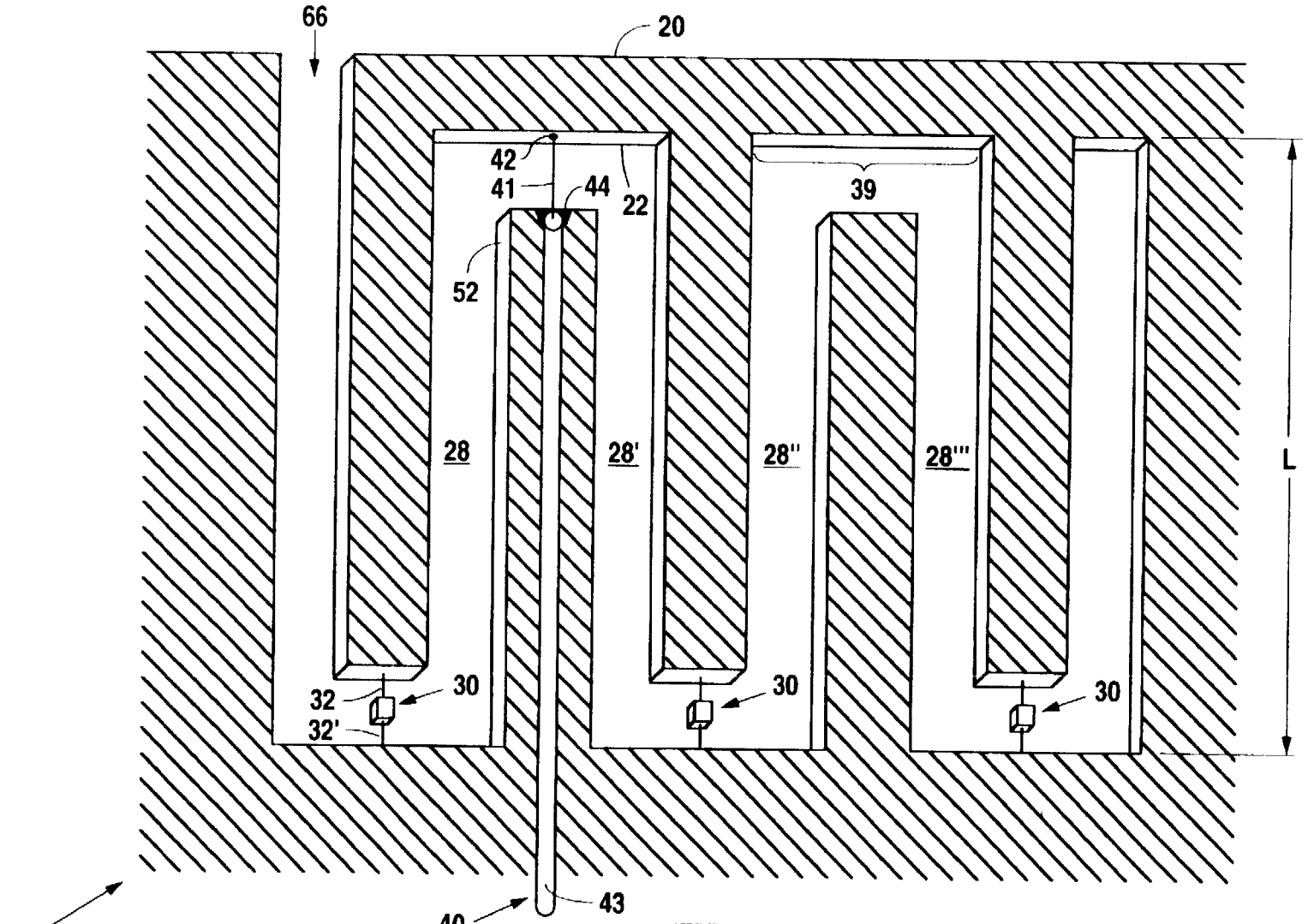
FIG. 1 schematically illustrates a meandered-slot switch-tuned monopole antenna.
Figure 2A:
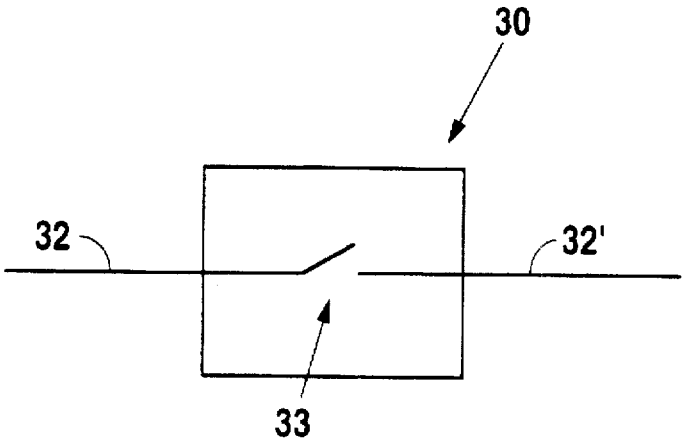
FIG. 2A schematically illustrates a switchable conducting element.

The present invention includes an electrically-short monopole antenna 99 having a monopole length L. The antenna 99 schematically illustrated in FIG. 1 comprises an electrically conductive sheet 20 comprising an elongated meandered slot 66 having first and second longitudinal slot edges 22,52 respectively. Meandered slot 66 comprises a plurality of substantially parallel meander sections 28,28', 28",28'", for example, of substantially uniform length L joined end-to-end in series at folds (as at fold 39 joining meander sections 28",28'"). Antenna 99 also comprises shunt RF switching means 30 comprising a plurality of switchable conducting elements 30 (schematically illustrated in FIG. 2A as comprising mechanical switch 33) connected via a path 32,32' of relatively low RF impedance substantially transversely across meandered slot 66 from first edge 22 to second edge 52.

Antenna 99 further comprises an antenna terminal pair 42,44 comprising first and second terminals 42,44 respectively located on conductive sheet 20 proximate first and second slot edges 22,52 respectively.

Figure 2B:
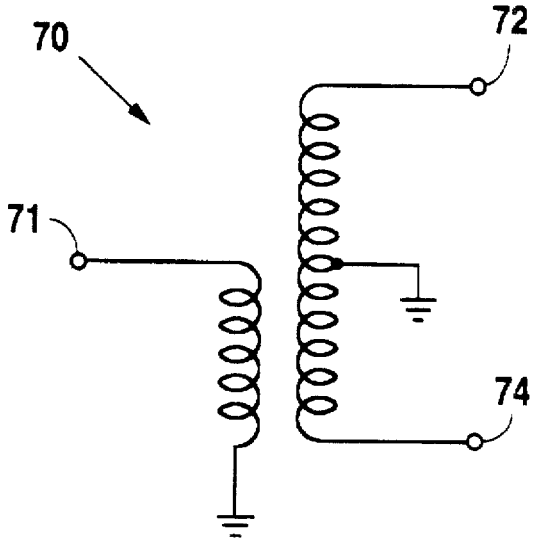
FIG. 2B schematically illustrates a balun for connecting two monopole antennas to an unbalanced transmission line.
Figure 3B:
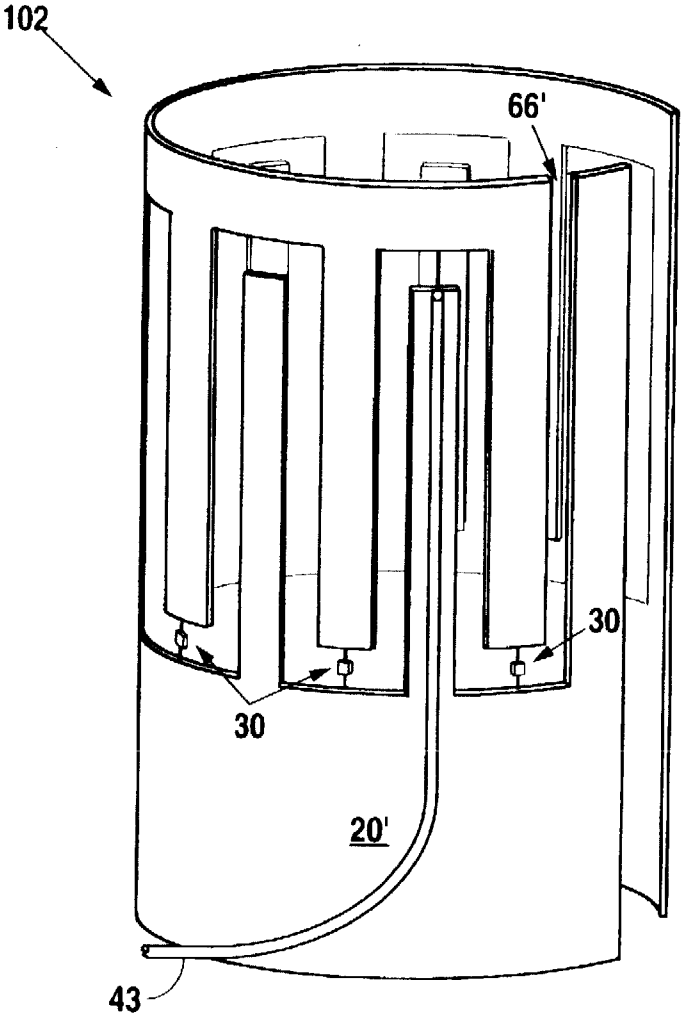
FIG. 3B schematically illustrates a meandered-slot switch-tuned monopole antenna in a substantially elliptical open form.
Figure 3A:
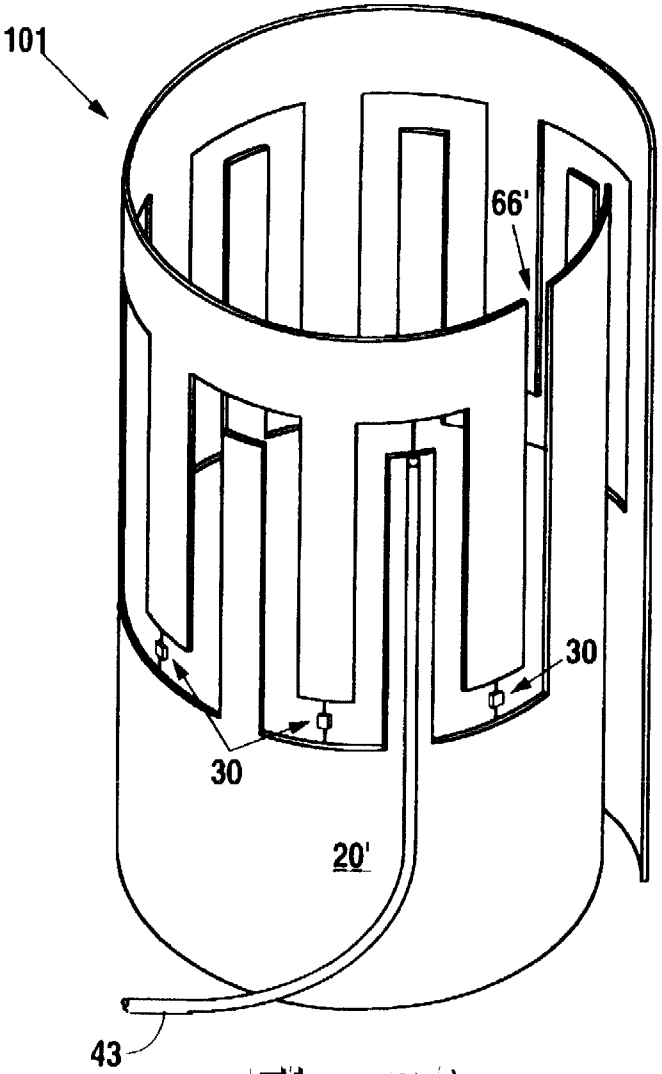
FIG. 3A schematically illustrates a meandered-slot switch-tuned monopole antenna in a substantially cylindrical form spiraling out.
Figure 3C:
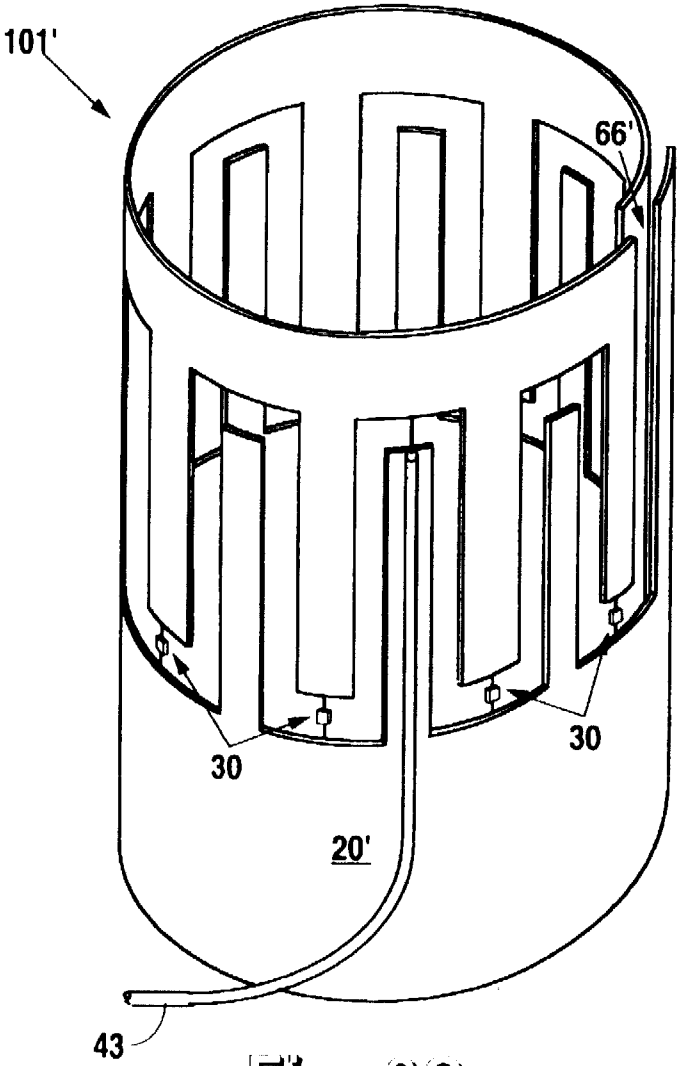
Figure 3D:
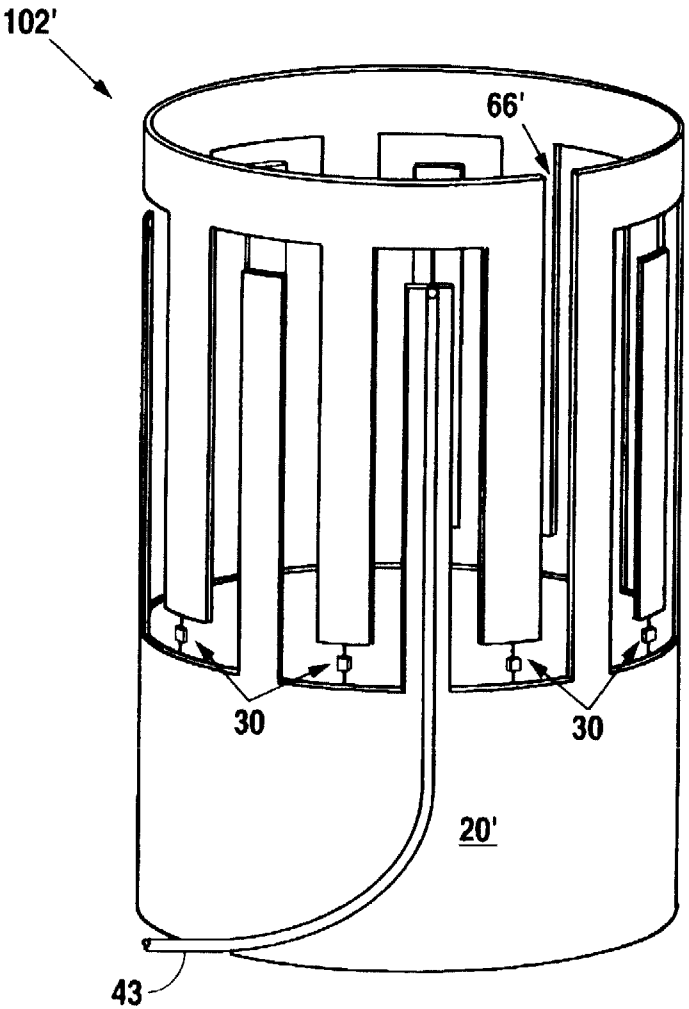
FIG. 3D schematically illustrates a meandered-slot switch-tuned monopole antenna in a substantially elliptical closed form.

Note that antenna 99 comprises three switchable conducting elements 30 connected across slot 66 at alternate folds. Note also that conductive sheet 20' can be folded into a substantially cylindrical form having a longitudinal axis substantially parallel to meander sections of meandered slot 66'. The substantially cylindrical form of folded conductive sheet 20' may spiral out or in to make monopole antennas 101,101' as in FIGS. 3A and 3C respectively. Alternative preferred antenna embodiments comprise a conductive sheet 20' folded into a substantially elliptical form also having a longitudinal axis substantially parallel to meander sections of meandered slot 66'. The substantially elliptical form of folded conductive sheet 20' may be either open or closed to make monopole antennas 102,102' as in FIGS. 3B and 3D respectively. A dipole antenna can be formed, for example, from first and second monopole antennas 101,101; 101', 101'; 102,102; or 102', 102' placed end-to-end, the first and second monopole antennas having first and second resonant frequencies respectively, and the first and second resonant frequencies being substantially equal. Balun means comprising, for example, the balun coil 70 schematically illustrated in FIG. 2B, may be used for coupling the first and second monopole antennas to an unbalanced transmission line by connecting terminals 72,74 of balun 70 to the first antenna terminal 42 of each of the first and second monopole antennas above. An unbalanced transmission line center conductor may then be connected to terminal 71. Note that balun means also comprises baluns which themselves comprise, for example, a piece of coaxial cable one-half wavelength long, as is well known to those skilled in the art.

What is claimed is:

1. An electrically-short monopole antenna having a monopole length, said antenna comprising an electrically conductive sheet comprising an elongated meandered slot having first and second longitudinal slot edges, said meandered slot comprising a plurality of substantially parallel meander sections of substantially uniform length joined end-to-end in series at folds;

shunt RF switching means comprising at least one switchable conducting element connected via a path of relatively low RF impedance substantially transversely across said meandered slot from said first edge to said second edge; and an antenna terminal pair comprising first and second terminals located on said conductive sheet proximate said first and second slot edges respectively, said first and second terminals being substantially opposite one another.

2. The antenna of claim 1 wherein said meandered slot comprises at least four meander sections.

3. The antenna of claim 1 wherein at least one said switchable conducting element comprises a mechanical switch.

4. The antenna of claim 1 wherein said antenna terminal pair is spaced on said elongated meandered slot between two of said switchable conducting elements.

5. The antenna of claim 1 wherein each said switchable conducting element is connected across said slot at a fold point.

6. The antenna of claim 5 wherein said shunt RF switching means comprises at least two switchable conducting elements, said at least two switchable conducting elements being connected across said slot at alternate folds.

7. The antenna of claim 1 wherein said substantially uniform length of said meander sections is substantially equal to said monopole length.

8. The antenna of claim 1 wherein each said meander section is closely coupled and electrically significant.

9. The antenna of claim 1 wherein said conductive sheet is folded in a substantially cylindrical form.

10. The antenna of claim 1 wherein said conductive sheet is folded in a substantially elliptical form.

11. A dipole antenna, comprising first and second monopole antennas as described in claim 1 placed end-to-end, said first and second monopole antennas having first and second resonant frequencies respectively, and said first and second resonant frequencies being substantially equal; and balun means for coupling said first and second monopole antennas to a coaxial transmission line.

12. A method of changing the resonant frequency of a dipole antenna, the method comprising providing a dipole antenna as described in claim 11, ; and switching at least one of said switchable conducting elements of said first and second monopole antennas to a conducting state to change said first and second resonant frequencies of said first and second monopole antennas to substantially equal a third resonant frequency.

13. A method of changing the resonant frequency of a monopole antenna, the method comprising providing a monopole antenna as described in claim 1, wherein each of said switchable conducting elements is in a nonconducting state; and switching one of said switchable conducting elements to a conducting state to change the resonant frequency of said monopole antenna.

14. A method of creating an antenna resonance within a predetermined range, the method comprising providing an antenna as described in claim 1;

spacing at least one said switchable conducting element of said shunt RF switching means along said meandered slot an effective distance from said antenna terminal pair to create an antenna resonance within the predetermined range when said at least one said switchable conducting element is switched to a conducting state; and switching said at least one switchable conducting element to a conducting state.

* * * * *